US007673964B2

(12) United States Patent
Furukawa

(10) Patent No.: US 7,673,964 B2
(45) Date of Patent: Mar. 9, 2010

(54) REMOVING MEMBER AND IMAGE FORMING APPARATUS

(75) Inventor: Juichi Furukawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 465 days.

(21) Appl. No.: 11/249,402

(22) Filed: Oct. 14, 2005

(65) Prior Publication Data

US 2006/0087530 A1 Apr. 27, 2006

(30) Foreign Application Priority Data

Oct. 19, 2004 (JP) ..... 2004-304745
Jun. 15, 2005 (JP) ..... 2005-175128

(51) Int. Cl.
*B41J 2/165* (2006.01)

(52) U.S. Cl. ..... 347/33; 347/32

(58) Field of Classification Search ..... 347/33, 347/29, 32, 45
See application file for complete search history.

(56) References Cited

U.S. PATENT DOCUMENTS 5,703,630 A * 12/1997 Murakami et al. ..... 347/45
6,084,608 A * 7/2000 Harvey et al. ..... 347/33
7,246,874 B2 * 7/2007 Hirakata et al. ..... 347/29
2005/0012798 A1 1/2005 Adachi et al.

FOREIGN PATENT DOCUMENTS

| | | | |
|---|---|---|---|
| JP | 55015873 | * | 2/1980 |
| JP | 02-289357 | | 11/1990 |
| JP | 04-140147 | | 5/1992 |
| JP | 05-008403 | | 1/1993 |
| JP | 05-201014 | | 8/1993 |
| JP | 06-305157 | | 11/1994 |
| JP | 2000-043278 | | 2/2000 |
| JP | 2002-292877 | | 10/2002 |

* cited by examiner

*Primary Examiner*—Shih-Wen Hsieh
(74) *Attorney, Agent, or Firm*—Oblon, Spivak, McClelland, Maier & Neustadt, L.L.P.

(57) ABSTRACT

A removing member for use in an image forming apparatus removes foreign materials from a nozzle face of a discharge head provided in the image forming apparatus. The removing member includes a base material, and fine particles disposed to the base material.

5 Claims, 4 Drawing Sheets

REMOVING MEMBER AND IMAGE FORMING APPARATUS

TECHNICAL FIELD

The present disclosure generally relates to a removing member for use in an image forming apparatus, and more specifically, to a removing member which removes fluid from a nozzle face of a discharge head, and an image forming apparatus including such discharge head and removing member.

BACKGROUND

In general, an image forming apparatus using an inkjet recording method needs to remove foreign material such as remaining ink, dust, and paper powder from a nozzle face of a discharge head (e.g., recording head) to secure a good image quality for image printing.

Conventionally, foreign material such as ink, dust, and paper powder adhered on the nozzle face of the discharge head (e.g., recording head) can be removed by a removing member such as a wiping blade made of rubber, for example.

Such rubber-made wiping blade can be made of materials such as silicone rubber, urethane rubber, hydrogenated nitrile butadiene rubber, ethylene propylene diene monomer (EPDM), and fluorine-containing rubber, for example. In addition, the wiping blade can be made of rubber having vulcanizing agent.

As for water repellency, which covers the nozzle face of the recording head (e.g., inkjet head), materials such as silicone resin, acrylic resin, fluorine resin, silicone modified fluorine resin, silicone modified acrylic resin, fluorine modified silicone resin, fluorine modified acrylic resin, acrylic modified silicone resin, acrylic modified fluorine resin can be used, for example.

The wiping blade contacts the nozzle face of the discharge head (e.g., recording head), thereby a friction occurs between the wiping blade and the discharge head.

Accordingly, the nozzle face needs friction-resistance or abrasion-resistance to prevent damages on the nozzle face, and the wiping blade also needs abrasion-resistance (e.g., anti-wear, anti-tear).

With such requirements, a fluorine resin having good lubricousness is conventionally used as the water repellent to cover the nozzle face.

FIG. 1 shows a schematic view when the wiping blade removes (or scrapes) foreign materials (e.g., ink) adhered on the nozzle face of the discharge head (e.g., recording head).

As shown in FIG. 1, a wiping blade 11 cleans a nozzle face 12 when the wiping blade 11 removes (or scrapes) ink 13 from the nozzle face 12. The wiping blade 11 moves in an arrow direction shown by "X" in FIG. 1.

If physical contact of the nozzle face 12 and the wiping blade 11 is tight, ink may not sneak through the wiping blade 11, thereby remaining ink 14 may not appear on a backside of the wiping blade 11 with respect to a moving direction of the wiping blade 11.

However, a complete physical contact of the nozzle face 12 and the wiping blade 11 is hard to attain due to reasons such as bumping of the wiping blade 11 on foreign materials (e.g., paper powder, fixed ink), bumping of the wiping blade 11 on a nozzle cover (not shown), smoothness level of the nozzle face 12, and irregularities on the wiping blade 11.

FIG. 2 shows a schematic view when the wiping blade 11 cleans the nozzle face 12 of the discharge head (e.g., recording head), but some ink is still adhered as remained ink 14 on the nozzle face 12.

If a gap between the wiping blade 11 and the nozzle face 12 is relatively small and the nozzle face 12 has relatively high ink repellency, ink may not sneak through the gap so easily.

However, if the gap is too large, ink may sneak through the gap easily, and resulting in remaining ink 14.

Such gap may be generated between the wiping blade 11 and the nozzle face 12 by reasons such as abrasion (or wear and tear) and scratches, which may happen on the wiping blade 11 and the nozzle face 12.

With repeated cleaning operations of the wiping blade 11 on the nozzle face 12, abrasion (or wear and tear) or scratches may happen on the nozzle face 12, thereby a gap may be unfavorably generated between the wiping blade 11 and the nozzle face 12.

Such gap may be generated significantly if the wiping blade 11 does not move on the nozzle face 12 smoothly (i.e., higher friction coefficient between the nozzle face 12 and wiping blade 11).

Generally, a fluorine resin having good lubricousness is preferably used as the water repellent to cover the nozzle face 12.

However, fluorine resin may not be preferable as a material for covering a surface of nozzle (e.g., nozzle face 12) because of a relatively high material cost.

Furthermore, the manufacturing yield of nozzle pieces is relatively lower because a nozzle has a complex shape but is required to be manufactured with higher precision dimensionally, thereby fluorine resin may not be preferable as a material for covering a surface of nozzle.

If the water repellent material covering the nozzle face of the discharge head (e.g., recording head) provided in an image forming apparatus of inkjet recording type has a good lubricousness such as fluorine resin, the nozzle face can secure anti-scratchness and abrasion-resistancy (e.g., anti-wear, anti-tear) even if a friction coefficient of the wiping blade is not so small.

Furthermore, the wiping blade can also secure abrasion-resistancy (e.g., anti-wear, anti-tear) if such water repellent material having a good lubricousness is used.

In view of such background, a discharge head (e.g., recording head) having a nozzle face, covered by less expensive water repellent material, has been desired because of the relatively expensive cost of fluorine resin.

Such less expensive water repellent materials having enough ink repellency includes silicone resin, for example.

Furthermore, in order to improve discharge stability of recording fluid (e.g., ink) having a smaller surface tension and rapid permeability, it is desired to employ a material having a higher ink repellancy than conventional fluorine resin to cover a nozzle face of a discharge head (e.g., recording head).

Materials having higher ink repellency include silicone resin, silicone modified acrylic resin, silicone modified fluorine resin, and fluorine modified silicone resin, for example.

These polymers having silicone polymer chains have relatively higher ink repellancy but lower lubricousness compared to fluorine resin, and also have a relatively lower hardness, thereby such polymers may unfavorable to preserve abrasion-resistancy and friction-resistancy of the nozzle face.

Furthermore, the wiping blade may show unfavorable phenomenon such as abrasion (or wear and tear) if such polymers are used.

SUMMARY

The present disclosure relates to a removing member for use in an image forming apparatus, which removes foreign materials from a nozzle face of a discharge head provided in the image forming apparatus. The removing member includes a base material, and fine particles disposed to the base material.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF EXAMPLE EMBODIMENTS

Figure 1:
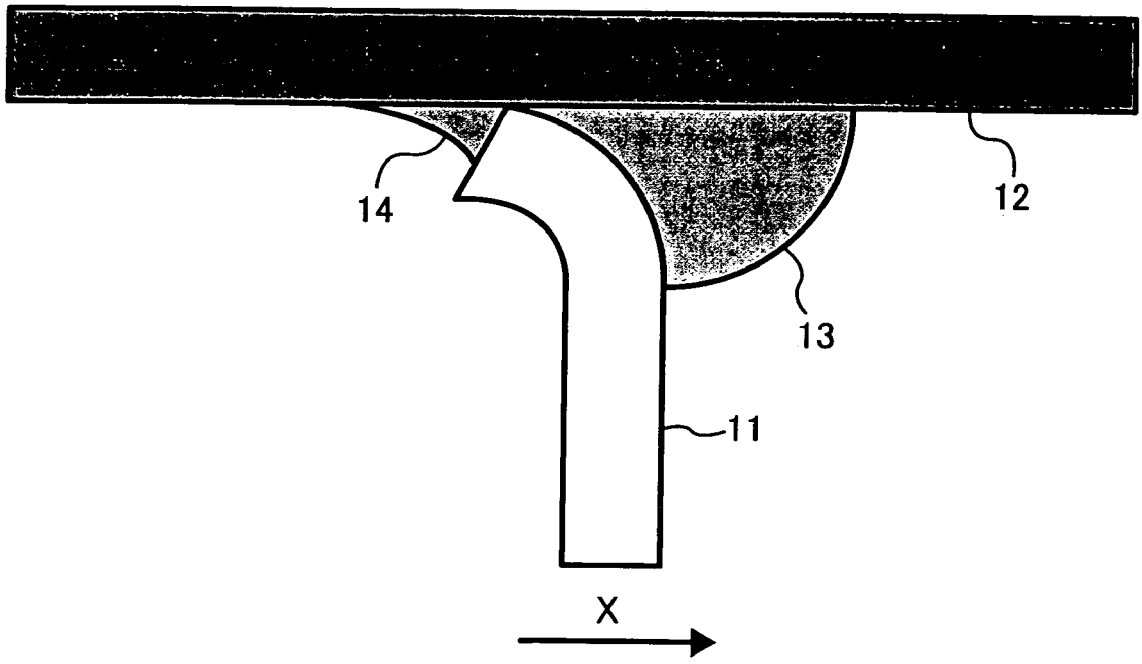
FIG. 1 is a schematic view when a wiping blade removes ink adhered on a nozzle face of a discharge head.
Figure 2:
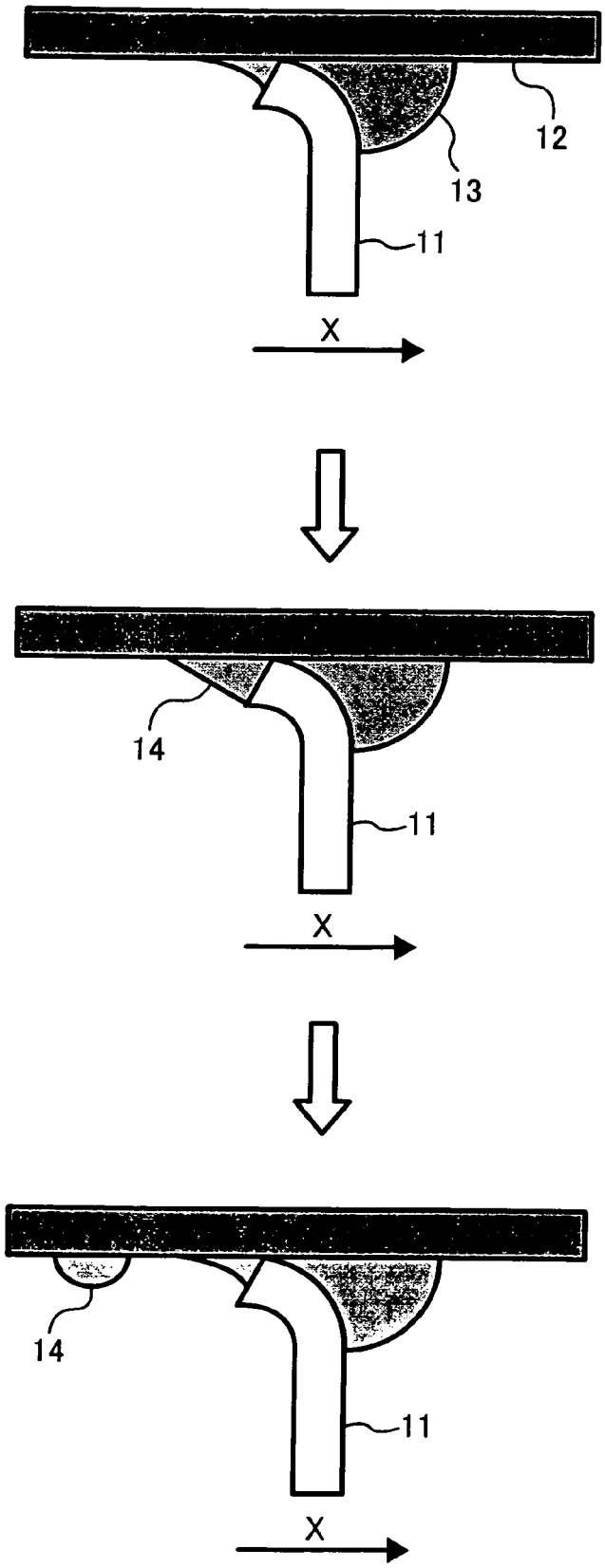
FIG. 2 is a schematic view when a wiping blade cleans a nozzle face of a discharge head, but some ink is still adhered as remained ink on a nozzle face.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, a removing member according to an example embodiment is described hereinafter.

The removing member according to an example embodiment includes following composite materials, which can improve lubricousness.

For example, a removing member includes a rubber-based material and fine particles, which can reduce friction coefficient, provided on a surface of the rubber-based material.

Another removing member includes a rubber-based material and coating material, which can reduce friction coefficient, provided on a surface of the rubber-based material.

Another removing member includes a rubber-based material and a material having lower friction coefficient, wherein the material forms a layered structure with the rubber-based material.

A removing member needs to have a plurality of properties such as elasticity, abrasion-resistancy (e.g., anti-wear, anti-tear), chemical resistance, and water resistance, for example.

In example embodiments to be described later, a composite material, constructed from rubber-based material having good properties in elasticity, abrasion-resistancy (e.g., anti-wear, anti-tear), chemical resistance, and water resistance, and a material having good lubricousness, is used to form a removing member having good lubricousness.

As above mentioned, a conventional wiping blade is made of rubber such as silicone rubber, urethane rubber, hydrogenated nitrile butadiene rubber, ethylene propylene diene monomer (EPDM), and fluorine-containing rubber, for example.

Specifically, the wiping blade made of EPDM or hydrogenated nitrilebutadiene has favorable properties with respect to abrasion-resistancy (e.g., anti-wear, anti-tear), chemical resistance, and water resistance.

The wiping blade according to example embodiments can employ the above-mentioned materials.

Hereinafter, a removing member is explained as a wiping blade in example embodiments, but the removing member can take on other shapes and be of other types such as a wiping roller, thereby the invention removing member is not limited to a wiping blade.

In one aspect of the invention, a removing member comprises a composite material including a rubber-based material and fine particles, which can reduce friction coefficient, provided on a surface of the rubber-based material.

Such fine particles include fluorine resin, molybdenum disulfide, silicone resin, high-molecular weight polyethylene, and graphite, for example.

Such fine particles also include fluorine modified resin, and silicone modified resin, for example.

The high-molecular weight polyethylene includes ultra high-molecular weight polyethylene (UHMW-PE) having an average molecular weight of one million or greater, for example. The UHMW-PE has good lubricousness and chemical resistance, and anti-aging property against acid or alkaline liquid such as ink, process liquid, and cleaning liquid, for example.

The fluorine resin includes PTFE (polytetrafluoroethylene), ETFE (ethylene-tetrafluoroethylene), and FEP (fluorinated ethylene propylene), for example, but not limited to these resins.

The fine particles can be provided on a surface of the wiping blade by disposing fine particles uniformly in a surface portion of the wiping blade or by disposing fine particles unevenly in a surface portion of the wiping blade.

It is preferable that the fine particles have uniform particle diameter size.

The fine particles can be kneaded with a blade base-material such as rubber, or fine particles can be disposed on a blade base-material such as rubber by applying an emulsion coating material, which disperses fine particles therein, on the blade base-material.

As such, fine particles having higher lubricousness than the blade base-material such as rubber are disposed on the surface of the blade base-material to form a composite material.

Such composite material can be formed with non-limiting methods including the above-mentioned methods.

The fine particles are not limited in size and preferably have a diameter of 0.01 to 2 μm to improve lubricousness of the wiping blade.

If the diameter of fine particles becoming too large, fine particles may tend to peel off from the wiping blade, and such phenomenon may if severe cause drawbacks such as larger friction and scratches on the nozzle face, nozzle clogging, and deflected discharging, which are not preferable for image quality.

If the diameter of fine particles becomes too small, the wiping blade may tend not have enough improved lubricousness because the rubber may affect lubricousness due to a smaller particle size of the fine particles, which is not preferable for image quality.

The fine particles more preferably have a diameter of 0.2 to 2 μm, in which the wiping blade can improve its durability to abrasion-resistancy (e.g., anti-wear, anti-tear) in addition to better friction-resistancy and abrasion-resistancy of the nozzle face. All particle sizes within the disclosed endpoints herein are also included as if written out.

Accordingly, an edge of the wiping blade may show anti-curling property, which results into a long-term durability of the wiping blade.

In another aspect of the invention, a removing member (e.g., wiping blade) comprises, or is entirely made of, a surface modified composite material including a rubber and fine particles, in which the fine particles cover a surface of the rubber to reduce friction coefficient of the removing member (e.g., wiping blade).

With providing the, e.g., wiping blade formed of such composite material in an image forming apparatus such as inkjet recording apparatus, abrasion (or wear and tear) and scratches on a nozzle face of a discharge head (e.g., recording head) can be reduced, thereby wiping deficiency such as incomplete wiping of the nozzle face may not happen in an image forming apparatus.

The resin can be uniformly kneaded with a blade base-material such as rubber, or resin can be dispersed mainly in a surface portion of the blade base-material.

The resin includes fluorine resin, silicone resin, silicone modified resin, and fluorine modified resin, for example.

The fluorine resin includes PTFE (polytetrafluoroethylene), ETFE (ethylene-tetrafluoroethylene), and FEP (fluorinated ethylene propylene), for example.

The silicone resin includes commercially available coating agent (e.g., silicone coating agent) having good lubricousness, for example.

The resin also includes high-molecular weight polyethylene, and acrylic resin, for example.

The high-molecular weight polyethylene includes ultra high-molecular weight polyethylene (UHMW-PE) having an average molecular weight of one million or greater, for example. The UHMW-PE has good lubricousness and chemical resistance, and anti-aging property, for example.

In another aspect of embodiment, a removing member (e.g., wiping blade) is made of a composite material including a rubber and fine particles, in which the fine particles are layered on a surface of the rubber to reduce friction coefficient of the removing member (e.g., wiping blade).

By providing a wiping blade formed of such composite material in an image forming apparatus such as inkjet recording apparatus, abrasion (or wear and tear) and scratches on a nozzle face of a discharge head (e.g., recording head) can be reduced, thereby the wiping deficiency such as incomplete wiping of the nozzle face may not happen in an image forming apparatus.

The resin to be layered on the wiping blade includes fluorine resin, silicone resin, fluorine modified resin, silicone modified resin, and high-molecular weight polyethylene, for example.

The high-molecular weight polyethylene includes ultra high-molecular weight polyethylene (UHMW-PE) having an average molecular weight of one million or greater, for example. The UHMW-PE has good lubricousness and chemical resistance, and anti-aging property, for example.

A nozzle face may be covered by a polymer material having a relatively lower hardness, wherein such polymer may include silicone polymer chain.

By using the above-mentioned wiping blade having a higher lubricousness with the nozzle face covered by polymer including silicone polymer chain, a friction effect between the wiping blade and the nozzle face can be reduced. Thereby, an adequate level of abrasion-resistancy (e.g., anti-wear, anti-tear) can be preserved.

As such, even if the water repellent polymer material having a smaller hardness (e.g., 700 N/mm$^2$ or smaller) covers a nozzle face of a discharge head (e.g., recording head), an adequate level of abrasion-resistancy (e.g., anti-wear, anti-tear) can be preserved by using the above-mentioned wiping blade having a higher lubricousness, for example.

In example embodiments, polymers having silicone polymer chains include silicone resin, silicone modified acrylic resin, silicone modified fluorine resin, fluorine modified silicone resin, and acrylic modified silicone resin, for example.

In example embodiments, polymers having silicone polymer chains can be cured in any methods such as room temperature curing, UV (ultra violet) ray curing, and thermosetting type, for example.

Specifically, the UV (ultra violet) ray curing is preferable because the curing can be conducted at room temperature (i.e., less restriction on manufacturing) and relatively hard water repellent layer can be formed.

The wiping blade removes foreign materials from the nozzle face when the wiping blade contactingly moves on the discharge head (e.g., recording head). At this time, the wiping blade can move on a nozzle array in any direction with respect to a direction of the nozzle array.

The discharge head, which discharges recording liquid, can include a piezo element, and more preferably can include a heating member.

The discharge head having the heating member can discharge recording liquid with an effect of bubble generated on the basis of a boiling phenomenon of liquid.

A large number of heating members can be easily provided in a discharge head with a semiconductor processing method so that a discharge head having multi-channel nozzles can be easily manufactured.

If a nozzle face becomes too large due to an introduction of long line head in an image forming apparatus, a shape of the wiping blade may be more likely to be deformed in general, thereby resulting into a difficulty of wiping operation.

However, if the wiping blade has a better lubricousness, the shape of the wiping blade may not be deformed significantly, thereby an image forming apparatus provided with a wiping blade according to example embodiments may prevent drawbacks such as insufficient wiping compared to an image forming apparatus using a conventional wiping blade.

The blade base-material includes rubber such as natural rubber (NR), isoprene rubber (IR), acrylonitrile butadiene rubber (NBR), butadiene rubber (BR), chloroprene rubber (CR), ethylene propylene diene monomer (EPDM), isobutylene-isoprene rubber (IIR), chlorinated isobutylene-isoprene rubber (CLIIR) fluorine-containing rubber, and silicone rubber, for example.

The blade base-material made of rubber can also include vulcanizing agent.

Compared to a vulcanizing agent using sulfur, organic peroxide vulcanizing agent can be uniformly dispersed in rubber, thereby such organic peroxide vulcanizing agent may not cause scratches on a nozzle face, and are preferred.

Such organic peroxide vulcanizing agent is commercially available.

Specifically, such organic peroxide vulcanizing agent includes 1,1-di-t-butylperoxyl-3,3,5-trimethylcyclohexane, di-t-butylperoxide, t-butylcumylperoxide, di-cumylperoxide, 2,5-dimethyl-2,5-di(t-butylperoxyl) hexane, 2,5-dimethyl-2,5-di(t-butylperoxyl) hexyne, 1,3 bis-(t-butylperoxyl-isopropyl) benzene, and t-butylperoxylisopropyl carbonate, for example.

Furthermore, the rubber can include reinforcement filler. Generally, the reinforcement filler has an average particle diameter of 200 nm or greater, and a thermal black having an average particle diameter of 450 to 556 nm is preferably used as reinforcement filler.

Furthermore, in order to prevent accumulation of ink on the wiping blade, the wiping blade preferably has ink repellancy, and preferably has sliding angle of 90° or less so that ink can slip off during a waiting period. The wiping blade more preferably has a sliding angle of 20° or less.

Furthermore, rubber used for wiping blade in an inkjet recording apparatus can include additives such as vulcanization accelerator, vulcanization assisting agent, anti-oxidizing agent, softening agent, plasticizing agent, and coloring agent, as required.

Because a nozzle face of a discharge head according to example embodiments has a longer durability, drawbacks such as lack of droplet or deflected discharging can be prevented for a long period of time. Thereby a higher image quality can be produced for a long period of time on a recording medium such as paper.

The lack of droplet means that recording fluid is not discharged from a nozzle face due to clogging of the nozzle face or meniscus deterioration, and the deflected discharging means that recording fluid is discharged to a direction deviated from a predetermined original direction due to stain (e.g., remained foreign materials) on the nozzle face, for example.

Figure 3:
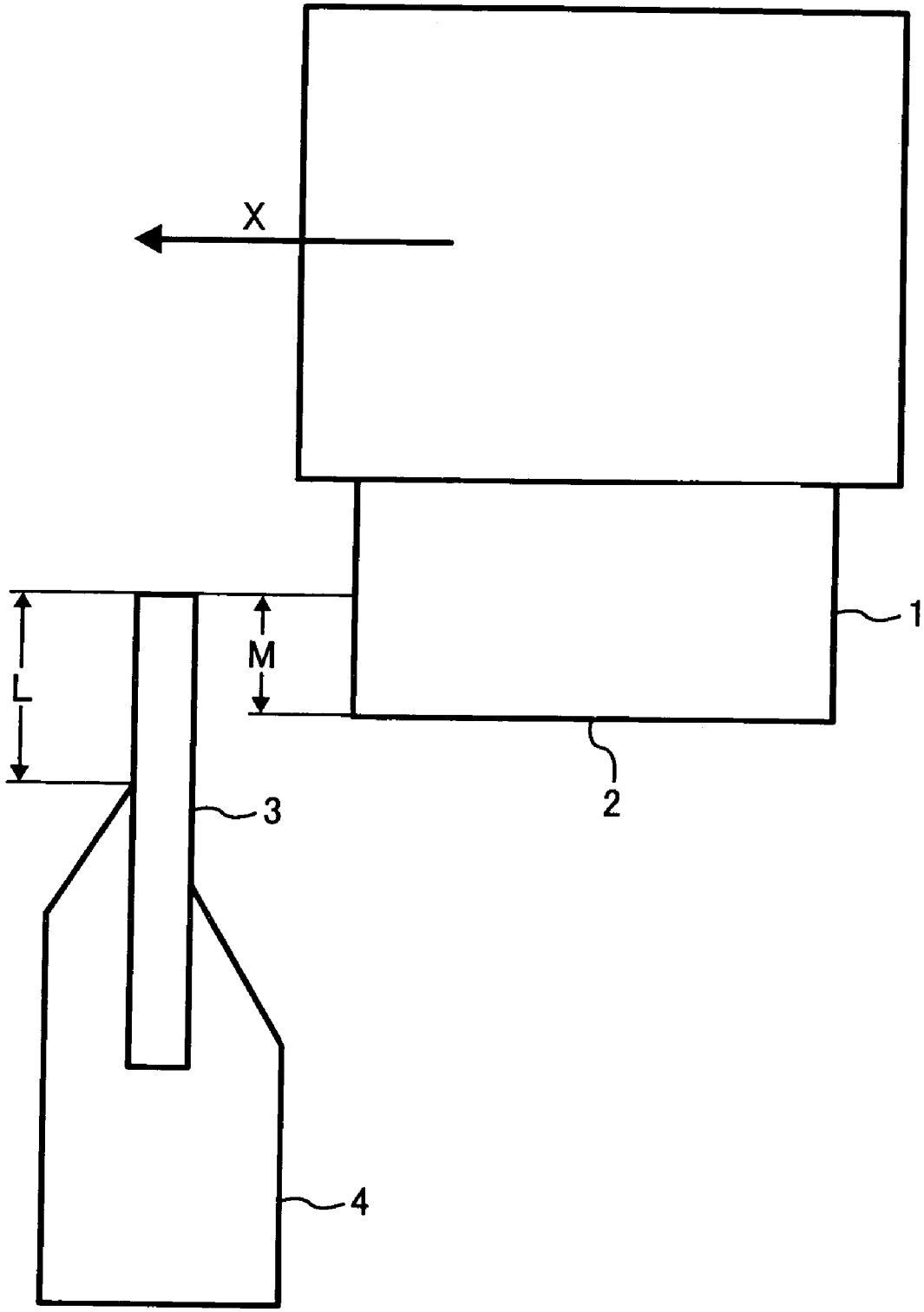
FIG. 3 is a schematic configuration of a discharge head, a wiping blade, and a blade support member provided in an image forming apparatus according to an example embodiment.

FIG. 3 shows a discharge head 1, a nozzle face 2, a wiping blade 3, a blade support member 4 according to an example embodiment of an image forming apparatus. The image forming apparatus includes an inkjet recording apparatus, for example.

In following examples, a modified IPSIO G707 (a product of Ricoh Company, Ltd.) was used as an inkjet recording apparatus.

As shown in FIG. 3, the discharge head 1 can move in an arrow direction shown by "X" in an image forming apparatus.

The wiping blade 3 is attached to a blade support member 4 while protruding one end of the wiping blade 3 from the blade support member 4 with a length "L" as shown in FIG. 3.

When the discharge head 1 moves in an arrow direction shown by "X" to clean the nozzle face 2, the wiping blade 3 is deflexed with a force applied by the discharge head 1 having an overlap length "M" shown in FIG. 3. The deflexed wiping blade 3 scrapes the nozzle face 2 to remove foreign materials adhered on the nozzle face 2.

FIGS. 4A to 4F show schematic structures of wiping blades according to example embodiments (Examples 1 to 19) and conventional wiping blade (Comparative Example 1).

Figure 4A:
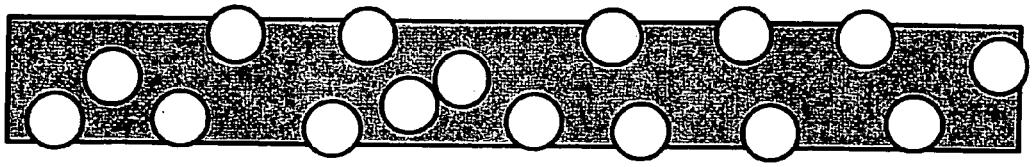
FIGS. 4A to 4F show schematic views explaining structures of wiping blades according to example embodiments (Examples 1 to 19) and conventional wiping blade.

FIG. 4A is a schematic structure of wiping blade of fine particle mixing type.

Figure 4B:
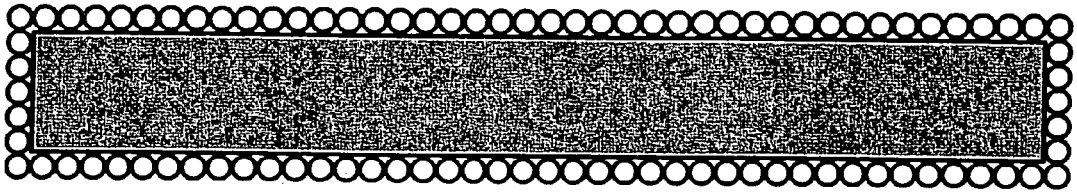

FIG. 4B is a schematic structure of wiping blade of fine particle coating type.

Figure 4C:
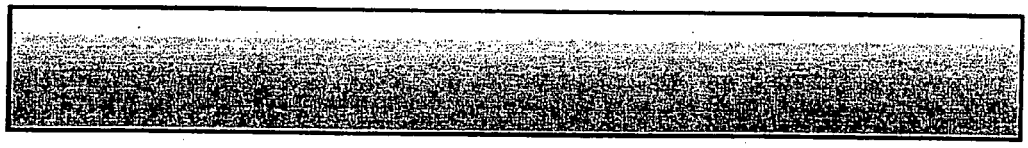

FIG. 4C is a schematic structure of wiping blade of resin mixing type.

Figure 4D:
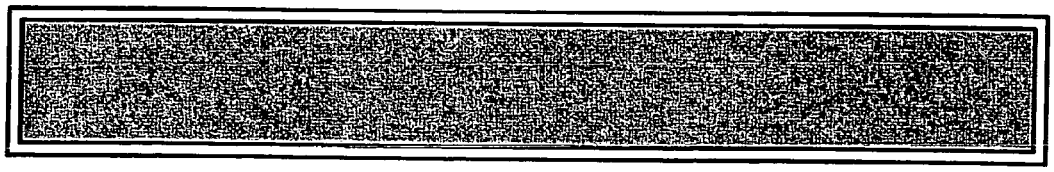

FIG. 4D is a schematic structure of wiping blade of resin coating type.

Figure 4E:
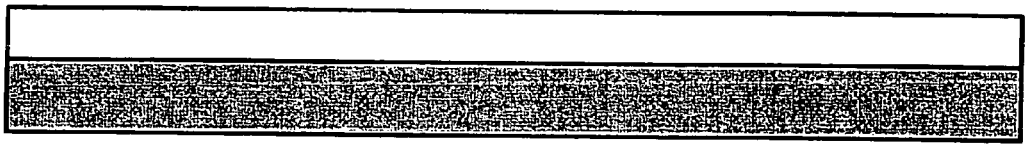

FIG. 4E is a schematic structure of wiping blade of resin layer type.

Figure 4F:
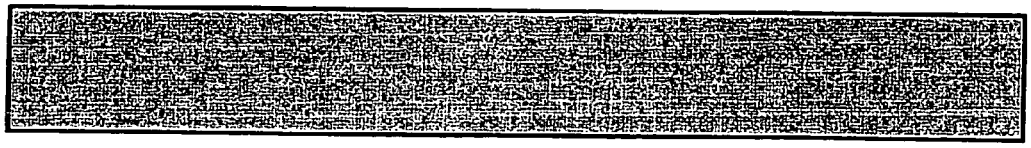

FIG. 4F is a schematic structure of conventional wiping blade.

In FIGS. 4A to 4F, white area indicates a material having higher lubricousness, and grey area indicates a rubber material.

Hereinafter, structures and preparation method of wiping blades according to example embodiments (Examples 1 to 19) are explained.

The wiping blade of fine particle mixing type was prepared as below.

As for the wiping blade of fine particle mixing type, fine particles disposed on a surface of rubber give lubricousness to the wiping blade.

EXAMPLE 1

Wiping Blade 1

EPDM (ethylene propylene diene monomer) and fine particles of PTFE (polytetrafluoroethylene) having a particle diameter of 0.01 μm were mixed with a volume ratio of 95:5, and formed in a plate-shape wiping blade.

EXAMPLE 2

Wiping Blade 2

EPDM and fine particles of PTFE (particle diameter of 0.2 μm) were mixed with a volume ratio of 95:5, and formed in a plate-shape wiping blade.

EXAMPLE 3

Wiping Blade 3

EPDM and fine particles of PTFE (particle diameter of 2 μm) were mixed with a volume ratio of 95:5, and formed in a plate-shape wiping blade.

EXAMPLE 4

Wiping Blade 4

EPDM and fine particles of PTFE (particle diameter of 5 μm) were mixed with a volume ratio of 95:5, and formed in a plate-shape wiping blade.

EXAMPLE 5

Wiping Blade 5

EPDM and fine particles of molybdenum disulfide (particle diameter of 0.2 μm) were mixed with a volume ratio of 95:5, and formed in a plate-shape wiping blade.

EXAMPLE 6

Wiping Blade 6

EPDM and silicone fine particles (particle diameter of 1 to 15 μm) were mixed with a volume ratio of 95:5, and formed in a plate-shape wiping blade.

Used silicone fine particles was TREFIL E-500 (a product of Dow Corning Corporation).

EXAMPLE 7

Wiping Blade 7

EPDM and graphite fine particles (particle diameter of 0.2 μm) were mixed with a volume ratio of 95:5, and formed in a plate-shape wiping blade.

EXAMPLE 8

Wiping Blade 8

EPDM and fine particles of high-molecular weight polyethylene (particle diameter of 0.2 μm, molecular weight of five millions) were mixed with a volume ratio of 95:5, and formed in a plate-shape wiping blade.

The wiping blade of fine particle coating type was prepared as below.

As for the wiping blade of fine particle coating type, emulsion fine particles coated on a surface of rubber give lubricousness to the wiping blade.

EXAMPLE 9

Wiping Blade 9

After coating a primer (mainly, silane coupling agent) on EPDM, emulsion coating material having PTFE as main component was coated on the EPDM to form a wiping blade.

Used emulsion coating material was POLYFLON PTFE enamel (a product of DAIKIN INDUSTRIES, LTD).

EXAMPLE 10

Wiping Blade 10

After dispersing fine particles of ethylene tetrafluoride in binder, fine particles of ethylene tetrafluoride was coated on the EPDM to form a wiping blade.

EXAMPLE 11

Wiping Blade 11

After dispersing fine particles of molybdenum disulfide (particle diameter of 0.2 μm) in binder, fine particles of molybdenum disulfide was coated on the EPDM to form a wiping blade.

EXAMPLE 12

Wiping Blade 12

After coating a primer (mainly, silane coupling agent) on EPDM, emulsion coating material having dispersed fine particles of silicone resin was coated on the EPDM to form a wiping blade.

Used emulsion coating material was x-52-8048 (a product of Shin-Etsu Chemical Co., Ltd.).

EXAMPLE 13

Wiping Blade 13

After dispersing fine particles of high-molecular weight polyethylene (particle diameter of 0.2 μm) in binder, fine particles of high-molecular weight polyethylene were coated on the EPDM to form a wiping blade.

EXAMPLE 14

Wiping Blade 14

After dispersing fine particles of graphite (particle diameter of 0.2 μm) in binder, fine particles of graphite were coated on the EPDM to form a wiping blade.

The wiping blade of resin mixing type was prepared as below.

As for the wiping blade of resin mixing type, mixed resin components give lubricousness to a surface of the wiping blade.

The resin components may be uniformly mixed with a rubber or mixed with a fine sea island structure in a rubber.

EXAMPLE 15

Wiping Blade 15

EPDM and MODIPER® F-3035 (a product of Nippon Oil & Fats CORPORATION) were mixed with a weight ratio of 97:3, and formed in a plate-shape wiping blade.

EXAMPLE 16

Wiping Blade 16

EPDM and MODIPER® FS-720 (a product of Nippon Oil & Fats CORPORATION) were mixed with a weight ratio of 97:3, and formed in a plate-shape wiping blade.

The wiping blade of resin coating type was prepared as below.

As for the wiping blade of resin coating type, resins coated on the surface of rubber give lubricousness to the surface of the wiping blade. Any coating methods can be used for coating.

EXAMPLE 17

Wiping Blade 17

After coating a primer (mainly, silane coupling agent) on EPDM, emulsion coating material was coated on the EPDM, and heated at 60 Celsius degrees for 2 hours to form a wiping blade.

Used emulsion coating material was x-71-130 (a product of Shin-Etsu Chemical Co., Ltd.).

EXAMPLE 18

Wiping Blade 18

After coating a primer (mainly, silane coupling agent) on EPDM, emulsion coating material was coated on the EPDM, and heated at 120 Celsius degrees for 2 hours to form a wiping blade.

Used emulsion coating material was SR2316 (a product of Dow Corning Corporation).

The wiping blade of layer type was prepared as below.

As for the wiping blade of layer type, resins layered on the surface of rubber give lubricousness to the surface of the wiping blade.

Such wiping blade was prepared as composite material by sticking films, for example, but any coating methods can be used for coating.

EXAMPLE 19

Wiping Blade 19

EPDM and ultra high-molecular weight polyethylene (UHMW-PE) having an average molecular weight of 5.5 millions were layered with each other to form a composite material, and the wiping blade was formed by cutting the composite material. The surface having polyethylene layer was used as removing face.

The wiping blade of conventional type was prepared as below. The conventional wiping blade is formed of rubber having lower lubricousness.

COMPARATIVE EXAMPLE 1

Wiping Blade 20

The wiping blade was uniformly formed of EPDM.

Hereinafter, experiments conducted by using Examples 1 to 19 (wiping blades 1 to 19) and Comparative Example 1 (wiping blade 20) are explained in detail.

Each of the wiping blades 1 to 19 according to Examples 1 to 19 was used to clean a nozzle face of a discharge head, which is covered by an ink repellant material (silicone resin "SR2316": a product of Dow Corning Corporation), wherein the discharge head was installed in an inkjet recording apparatus (modified IPSIO G707, a product of Ricoh Company, Ltd.).

Each of the wiping blades had a JIS K6253 hardness of A30 to A80, and a thickness of 0.5 to 2.0 mm.

Each of the wiping blades had a length "L" of 3 to 10 mm, and an overlap length "M" of 0.5 to 2.0 mm when the wiping blade 2 was fixed to the blade support member 4.

In such inkjet recording apparatus, the wiping blade conducted 3,000 times of wiping operation of removing ink adhered on the nozzle face.

After the 3,000 times of wiping operation, each of the nozzle faces was observed to evaluate friction-resistancy or abrasion-resistancy of the nozzle face with three grades: "good" with a mark "G", "not so good" with a mark "N", and "bad" with a mark "P."

Table 1 shows the result of the above experiment.

TABLE I

| | | Example 1 | Example 2 | Example 3 | Example 4 | Example 5 |
|---|---|---|---|---|---|---|
| Wiping blade | | 1 | 2 | 3 | 4 | 5 |
| Nozzle face | Friction-resistancy | G | G | G | N | G |
| | Scratches | G | G | G | N | G |
| | | Example 6 | Example 7 | Example 8 | Example 9 | Example 10 |
| Wiping blade | | 6 | 7 | 8 | 9 | 10 |
| Nozzle face | Friction-resistancy | N | G | G | G | G |
| | Scratches | N | G | G | G | G |
| | | Example 11 | Example 12 | Example 13 | Example 14 | Example 15 |
| Wiping blade | | 11 | 12 | 13 | 14 | 15 |
| Nozzle face | Friction-resistancy | G | G | G | G | G |
| | Scratches | G | G | G | G | G |
| | | Example 16 | Example 17 | Example 18 | Example 19 | Comparative Example 1 |
| Wiping blade | | 16 | 17 | 18 | 19 | 20 |
| Nozzle face | Friction-resistancy | G | G | G | G | P |
| | Scratches | G | G | G | G | P |

As shown in Examples 1 to 4 in Table 1, the wiping blade having fine particles on its surface show favorable friction-resistancy or abrasion-resistancy when the particle diameter is 0.01 to 2.0 μm.

As shown in Table 1, Comparative Example 1, which uses a wiping blade formed only by EPDM having lower lubricousness, shows unfavorable results such as abrasion (or wear and tear) and scratches on the nozzle face.

Compared to Comparative Example 1, Examples 1 to 19 show favorable results in friction-resistancy or abrasion-resistancy (e.g., anti-wear, anti-tear) of the nozzle face by providing lubricousness to the wiping blades of Examples 1 to 19.

Hereinafter, experiments conducted by using Examples 1 to 4 and Comparative Examples 2 to 5 are explained.

Comparative Examples 2 to 5 correspond to Examples 1 to 4 (i.e., using same structure respectively) except that experiments for Comparative Examples 2 to 5 were conducted with 30,000 times of wiping operation.

After the 3,000 times and 30,000 times of wiping operation, each of the wiping blades was observed to evaluate abrasion (or wear and tear) of the wiping blade compared to the wiping blade before wiping operation with two grades: "no change" with a mark "NC", and "rounded edge due to abrasion" with a mark "R."

Table 2 shows the result of the above experiment.

TABLE 2

| | Example 1 | Example 2 | Example 3 | Example 4 |
|---|---|---|---|---|
| Number of wiping operation (times) | 3,000 | 3,000 | 3,000 | 3,000 |
| Fine particle diameter (μm) | 0.01 | 0.2 | 2 | 5 |
| Abrasion of wiping blade | NC | NC | NC | NC |
| | Comparative Example 2 | Comparative Example 3 | Comparative Example 4 | Comparative Example 5 |
| Number of wiping operation (times) | 30,000 | 30,000 | 30,000 | 30,000 |
| Fine particle diameter (μm) | 0.01 | 0.2 | 2 | 5 |
| Abrasion of wiping blade | R | NC | NC | NC |

Hereinafter, experiments conducted by using Example 20 and Comparative Example 6 are explained.

Example 20 has a similar structure of Example 11 except that the water repellant "SR2316" covering the nozzle face in Example 11 was changed to "Ni-PTFE (poly tetra fluoro ethylene)" in Example 20.

Comparative Example 6 has a similar structure of Comparative Example 1 except that the water repellant "SR2316" covering the nozzle face in Comparative Example 1 was changed to "Ni-PTFE" in Comparative Example 6.

Ni-PTFE has higher hardness and lubricousness compared to SR2316.

With Examples 11 and 20, and Comparative Examples 1 and 6, the wiping blade conducted 3,000 times of wiping operation of removing ink adhered on the nozzle face.

After 3,000 times of wiping operation, each of the nozzle faces was observed to evaluate friction-resistancy or abrasion-resistancy of the nozzle face with three grades: "good" with a mark "G", "not so good" with a mark "N", and "bad" with a mark "P."

Table 3 shows the result of the above experiment.

TABLE 3

| | | Example 11 | Example 20 | Comparative Example 1 | Comparative Example 6 |
|---|---|---|---|---|---|
| Wiping blade | | 11 | 11 | 20 | 20 |
| Water repellant | | SR2316 | Ni-PTFE | SR2316 | Ni-PTFE |
| Nozzle face | Friction-resistancy | G | G | P | G |
| | Scratches | G | G | P | G |

In this experiment, a hardness of water repellent was measured with a surface measurement apparatus (FISCHERSCOPE® H100U), wherein measurement conditions were F=0.6 mN/6 s, C=5 s, R=−0.6 mN/6 s.

"F" is a load increasing condition, and "0.6 mN/6 s" means that a load is increased at a rate of 0.6 mN/sec for 6 seconds. "C" a creeping condition, and "5 s" means that a load is maintained for 5 seconds. "R" is a load decreasing condition, and "−0.6 mN/6 s" means that a load is decreased at a rate of 0.6 mN/sec for 6 seconds.

And following measurement results were obtained for surface hardness.

SR2316: 34 N/mm$^2$, Ni-PTFE: 768 N/mm$^2$

If a nozzle face is covered by a polymer material (e.g., silicone polymer chain) having a relatively lower hardness, it may not be preferable from the view point of abrasion-resistancy.

However, if the above-mentioned wiping blade having a higher lubricousness is used, a friction effect between the wiping blade and the nozzle face can be reduced. Thereby, an adequate level of abrasion-resistancy (e.g., anti-wear, anti-tear) can be preserved even if such polymer material having a relatively lower hardness is used.

Hereinafter, experiments conducted by using Example 11 and Comparative Example 1 in an image forming apparatus are explained.

An image forming apparatus using Example 11 was referred as an inkjet recording apparatus A (modified IPSIO G707, A-type).

Another image forming apparatus using Comparative Example 1 was referred as an inkjet recording apparatus B (modified IPSIO G707, B-type).

After conducting 30,000 times of wiping operation in the inkjet recording apparatuses A and B, printing operation was conducted by the inkjet recording apparatuses A and B. Then, image quality of the printed image was compared between the inkjet recording apparatuses A and B. Each of the nozzle faces was observed to evaluate friction-resistancy or abrasion-resistancy of the nozzle face with two grades: "good" with a mark "G", and "bad" with a mark "P."

Table 4 shows the result of the above experiment.

TABLE 4

| | | Image forming apparatus | |
|---|---|---|---|
| | | A-type | B-type |
| Wiping blade | | 11 | 20 |
| Water repellant | | SR2316 | SR2316 |
| Number of wiping operation (times) | | 30,000 | 30,000 |
| Nozzle face | Friction-resistancy | G | P |
| | Scratches | G | P |
| Deflected Discharging | | Not observed | Observed |
| Lack of droplet | | Not observed | Observed |

In the inkjet recording apparatus B using a conventional wiping blade, degradation of image quality was observed on the printed image because of deflected discharging or lack of droplet caused by abrasion (or wear and tear) or scratches on the nozzle face.

In the inkjet recording apparatus A using a wiping blade according to an example embodiment, degradation of image quality was not observed on the printed image. Numerous additional modifications and variations are possible in light of the above teachings. It is therefore to be understood that within the scope of the appended claims, which are incorporated into this specification and make up a part thereof, the disclosure of the present invention may be practiced otherwise than as specifically described herein.

This application claims priority from Japanese patent applications No. 2004-304745 filed on Oct. 19, 2004 and No. 2005-175128 filed on Jun. 15, 2005 in the Japan Patent Office, the entire contents of which are hereby incorporated by reference herein.

What is claimed is:

1. A wiping blade, comprising:

a base material;

wherein said wiping blade is configured to remove a foreign material from a nozzle face of a discharge head provided in an image forming apparatus;

wherein said wiping blade is entirely made of a surface modified composite material comprising a rubber and a resin, wherein said rubber is said base material;

wherein said resin is in the form of resin particles and said resin particles are disposed and condensed on an entire surface of the rubber to reduce a friction coefficient of the wiping blade.

2. An image forming apparatus, comprising:

a nozzle having a face; and the wiping blade of claim 1.

3. The image forming apparatus according to claim 2, wherein the nozzle face has an area covered by a water repellent material having a hardness of 8 to 700 N/mm$^2$.

4. The image forming apparatus according to claim 3, wherein the water repellent material comprises a polymer having silicone polymer chain.

5. The image forming apparatus according to claim 2, wherein the apparatus further comprises a heating member configured to discharge fluid.

* * * * *